US008689399B2

(12) United States Patent
Liu et al.

(10) Patent No.: US 8,689,399 B2
(45) Date of Patent: Apr. 8, 2014

(54) BAG RELEASE HANDLE FOR A FLOOR CLEANER

(75) Inventors: Andrew Q. Liu, Twinsburg, OH (US); Mark E. Cipolla, Chardon, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 460 days.

(21) Appl. No.: 13/046,406

(22) Filed: Mar. 11, 2011

(65) Prior Publication Data

US 2011/0219578 A1 Sep. 15, 2011

Related U.S. Application Data

(60) Provisional application No. 61/313,402, filed on Mar. 12, 2010.

(51) Int. Cl.
*A47L 9/10* (2006.01)

(52) U.S. Cl.
USPC ..... 15/347; 15/350; 15/410; 15/DIG. 8; 55/373; 55/379

(58) Field of Classification Search
USPC ..... 15/347, 350, 351, 410, DIG. 8; 55/373, 55/379
IPC ..... A47L 9/10
See application file for complete search history.

(56) References Cited

U.S. PATENT DOCUMENTS

| | | | | |
|---|---|---|---|---|
| 3,683,599 | A | 8/1972 | Malz | |
| 4,443,910 | A | 4/1984 | Fitzwater | |
| 4,449,737 | A | 5/1984 | Specht | |
| 4,452,618 | A | 6/1984 | Kaplas | |
| 4,591,369 | A | 5/1986 | Stewart, Sr. et al. | |
| 4,632,312 | A | 12/1986 | Premo et al. | |
| 5,089,038 | A | 2/1992 | Kopco et al. | |
| 5,092,915 | A | 3/1992 | Lackner | |
| 5,544,385 | A | 8/1996 | Jailor et al. | |
| 5,755,009 | A | 5/1998 | Stephens et al. | |
| 6,086,649 | A | 7/2000 | Tuvin et al. | |
| 6,115,881 | A | 9/2000 | Hult et al. | |
| 6,875,255 | B2 | 4/2005 | Alford et al. | |
| 7,134,694 | B2 | 11/2006 | Young et al. | |
| 7,258,709 | B2 | 8/2007 | Ponjican et al. | |
| 7,325,272 | B2 * | 2/2008 | Bosses | 15/327.2 |
| 2009/0089966 | A1 | 4/2009 | Sohn et al. | |

FOREIGN PATENT DOCUMENTS

| | | | |
|---|---|---|---|
| DE | 102008037409 | A1 | 6/2009 |
| GB | 2140288 | A | 11/1984 |
| GB | 2407257 | A | 4/2005 |

OTHER PUBLICATIONS

GB1216009.9 Examination Report dated Nov. 22, 2013 (3 pages).

* cited by examiner

*Primary Examiner* — David Redding
(74) *Attorney, Agent, or Firm* — Michael Best & Friedrich LLP

(57) ABSTRACT

A floor cleaner including a nozzle and a handle assembly pivotably mounted to the nozzle. The handle assembly including a handle, a motor housing supporting a suction source in fluid communication with the nozzle, and a bag housing defining a filter cavity. A door is removably coupled to the handle assembly and includes a retainer configured to secure a filter bag including a bag aperture to the door such that the door and the retainer are removable from the handle assembly as an assembly. The retainer includes a retainer handle positioned above the bag aperture.

20 Claims, 7 Drawing Sheets

BAG RELEASE HANDLE FOR A FLOOR CLEANER

RELATED APPLICATIONS

This patent application claims priority to U.S. Provisional Patent Application No. 61/313,402 filed Mar. 12, 2010, the contents of which are hereby incorporated by reference in their entirety herein.

BACKGROUND

The present invention relates to floor cleaners. Specifically, the present invention relates to floor cleaners that utilize a filter bag, and structures for retaining the filter bag.

Typical upright floor cleaners include a suction source and a nozzle. Filter bags are commonly used to filter air drawn through the nozzle by the suction source to trap debris and dust. A filter bag door may be used to protect the filter bag and to avoid contact between a user and the filter bag during use of the vacuum.

SUMMARY

In one embodiment, the invention provides a floor cleaner that includes a nozzle and a handle assembly pivotably mounted to the nozzle. The handle assembly includes a handle, a motor housing that supports a suction source in fluid communication with the nozzle, and a bag housing that defines a filter cavity. A door is removably coupled to the handle assembly and includes a retainer configured to secure a filter bag including a bag aperture to the door such that the door and the retainer are removable from the handle assembly as an assembly. The retainer includes a retainer handle positioned above the bag aperture.

In another embodiment, the invention provides a floor cleaner that includes a nozzle and a handle assembly pivotably mounted to the nozzle. The handle assembly includes a handle, a motor housing that supports a suction source in fluid communication with the nozzle, and a bag housing that defines a filter cavity. A door is configured to be removably coupled to the housing and includes a filter bag receiving portion that defines an aperture and a filter bag retainer configured to be selectively coupled to the filter bag receiving portion and configured to selectively couple a filter bag, having a collar and a bag aperture, to the filter bag receiving portion.

The filter bag retainer includes a handle and a living spring formed on the handle. The filter bag retainer is configured to be movable between an engaged position and a disengaged position, and the living spring is configured to bias the filter bag retainer toward the engaged position. The door and the filter bag retainer are preferably configured to be removable from the handle assembly together as an assembly.

In another embodiment, the invention provides a floor cleaner that includes a nozzle and a handle assembly pivotably mounted to the nozzle. The handle assembly includes a handle, a motor housing that supports a suction source in fluid communication with the nozzle, and a bag housing that defines a filter cavity. A door is configured to be removably coupled to the housing, and includes a filter bag receiving portion that defines an aperture and a filter bag retainer configured to be selectively coupled to the filter bag receiving portion and configured to selectively couple a filter bag, having a collar and a bag aperture, to the filter bag receiving portion. The filter bag retainer includes a handle and a retainer leg configured to engage the collar, and is configured to be movable between an engaged position and a disengaged position. The door and the filter bag retainer are preferably configured to be removable from the handle assembly together as an assembly Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. In the following description, "up" refers to a direction perpendicular to a floor and extending vertically away from the floor, and "down" refers to a direction opposite "up" and toward the floor. Likewise, "top" refers to a location above, or in a direction vertically down with respect to a reference and "bottom" refers to a location below, or in a direction vertically down with respect to a reference. Similar references and descriptions will be obvious to a reasonable observer. For example, an object near the bottom of a body is closer to the bottom of the body than the top.

Figure 1:
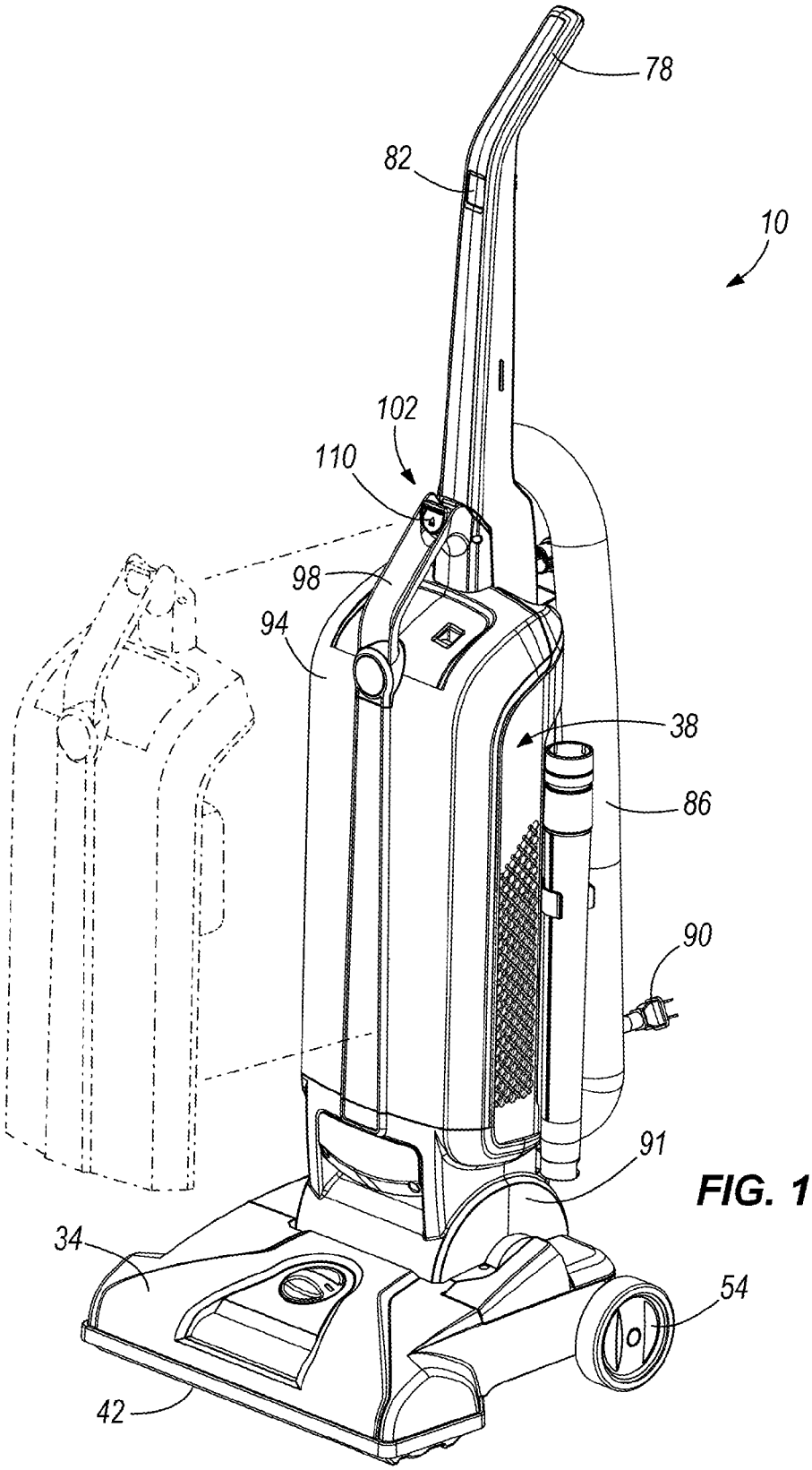
FIG. 1 is a perspective view of a floor cleaner according to the present invention.
Figure 2:
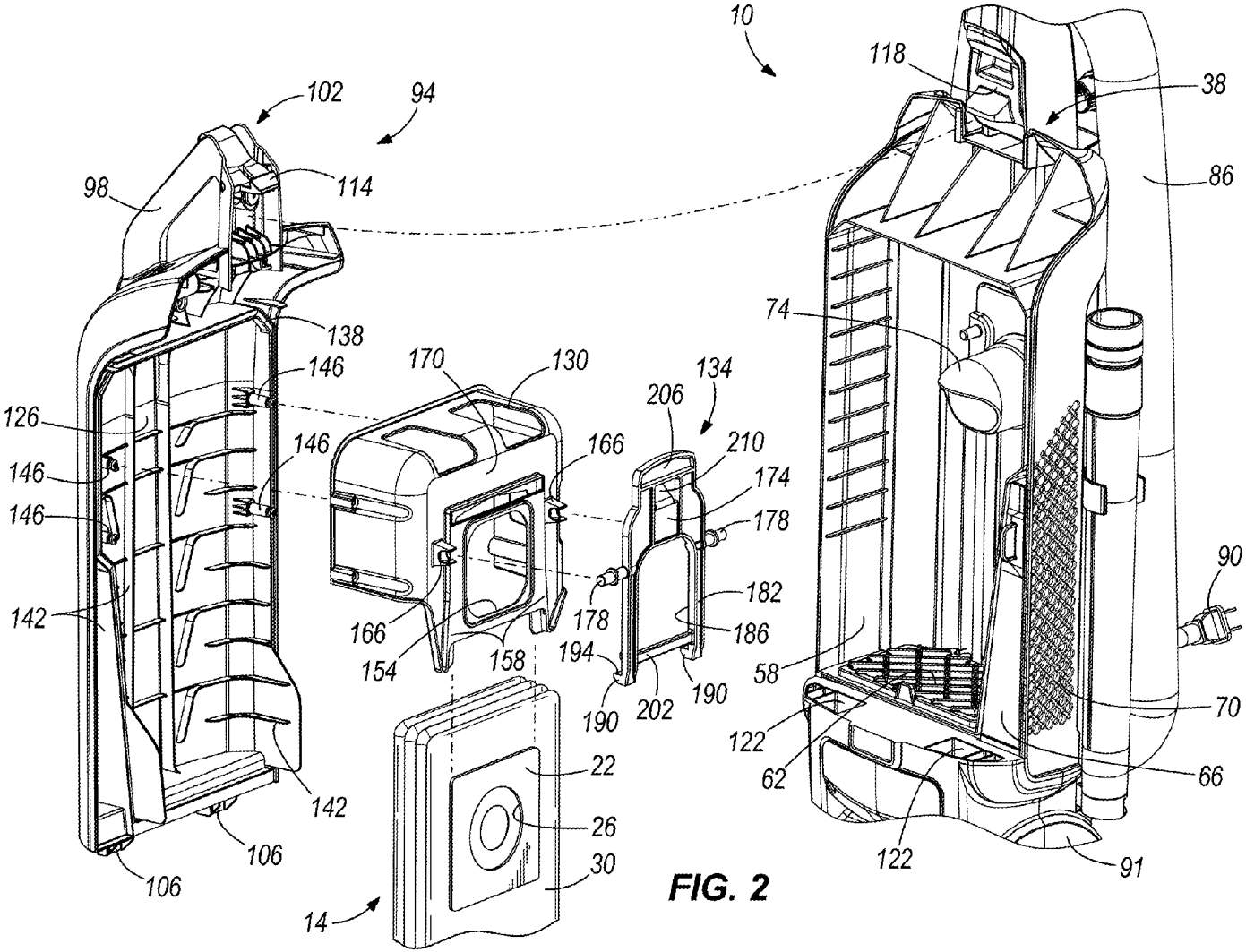
FIG. 2 is an exploded perspective view of portions of the floor cleaner of FIG. 1.
Figure 3:
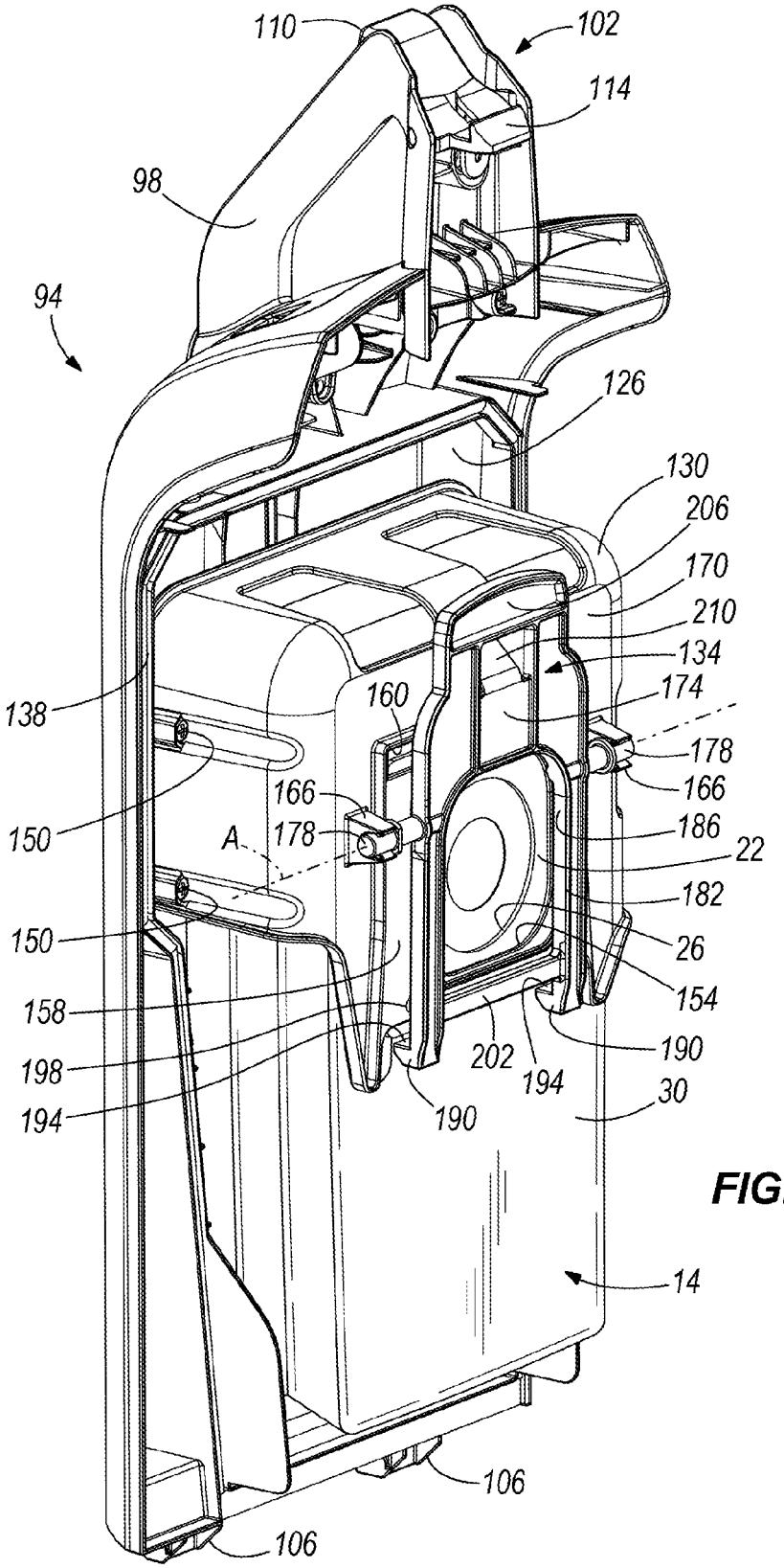
FIG. 3 is a perspective view of a vacuum door assembly removed from the floor cleaner of FIG. 1 including the filter bag.
Figure 4:
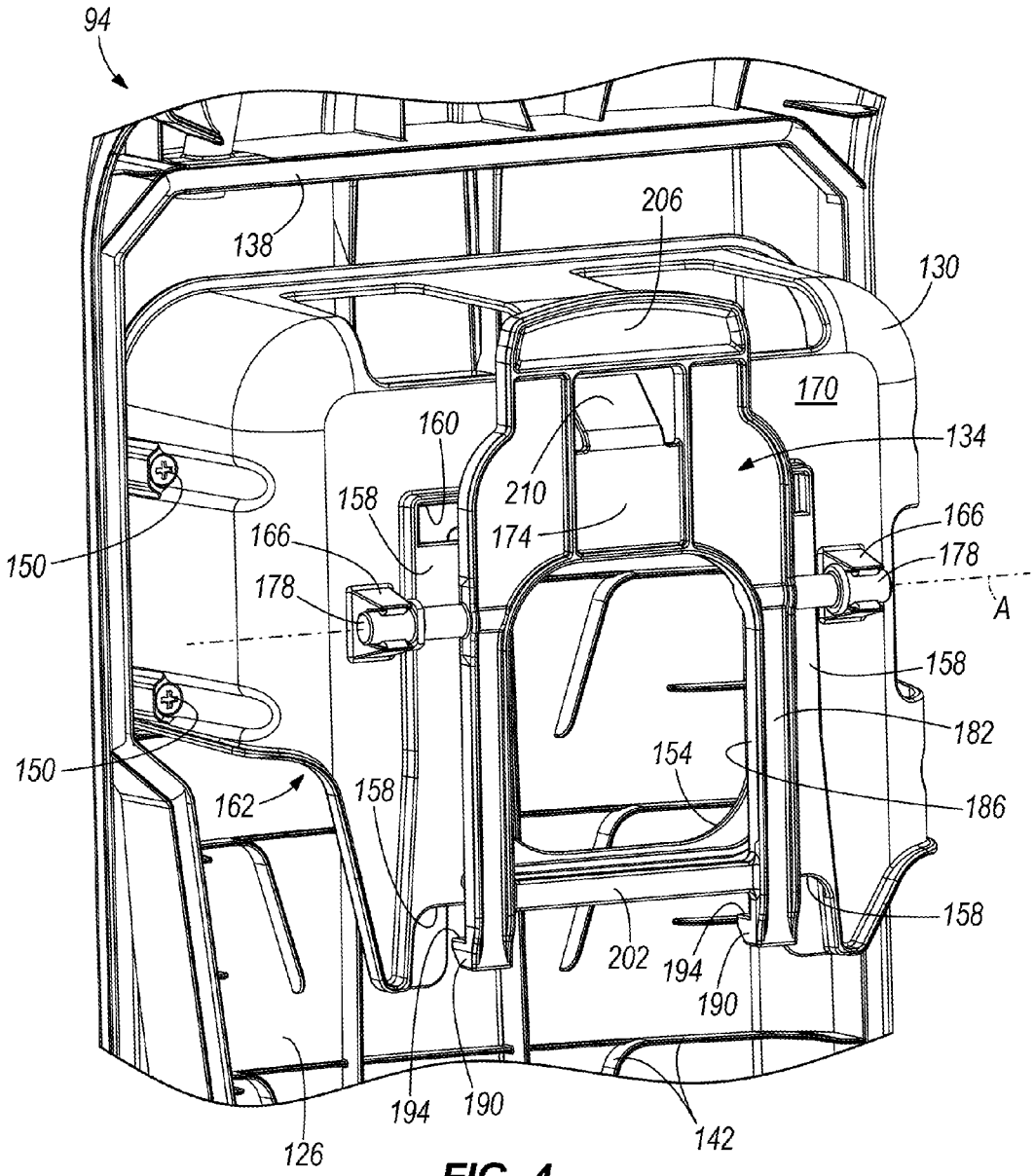
FIG. 4 is a close-up view of a vacuum door assembly removed from the floor cleaner of FIG. 1.

FIG. 1 shows a floor cleaner 10 or a vacuum cleaner that utilizes a filter bag 14 (see FIG. 2). The filter bag 14 includes a collar 22 (FIG. 3) that defines a bag aperture 26, and a filter portion 30. Filter bags 14 are known and often constructed of filter fiber or paper. The collar 22 is typically constructed of cardboard but may be made of other materials, as desired.

Referring again to FIG. 1, the floor cleaner 10 includes a base portion 34 and a handle assembly 38 that rotates relative to the base portion 34. The base portion 34 includes a nozzle 42. Opposed sets of wheels 54 (only one of which is shown) are rotatably connected to the base portion 34 such that the floor cleaner 10 can move across the floor, as is well-known in the art.

With respect to FIG. 2, the handle assembly 38 is rotatably connected to the base portion 34 and defines a dust cavity 58. The dust cavity 58 includes a suction vent 62 within the dust cavity 58, a filter 66 within the dust cavity 58, and an exhaust vent 70 that communicates between the filter 66 and the atmosphere outside the dust cavity 58. A dust tube 74 extends through the handle assembly 38 and extends into the dust cavity 58. A first air flow path is defined between the nozzle 42 and dust tube 74 such that the suction created by a fan (not shown) provides an air flow from the nozzle 42 through the dust tube 74. A second air flow path is defined between the suction vent 62 and the exhaust vent 70 such that the suction created by the fan provides an air flow from the suction vent 62 to the fan, then to the exhaust vent 70. During operation of the floor cleaner 10, a motor (not shown) rotates the fan such that air, dirt, and dust are sucked through the nozzle 42, flow through the first air flow path, into the filter bag 14 where dirt, dust, and other debris are trapped, and through the second air flow path to the atmosphere. Of course, other flow paths are possible.

Referring back to FIG. 1, the handle assembly 38 further includes a cleaner handle 78, vacuum controls 82, an extension tube 86, a power cord 90, and a motor housing 91 that supports the fan or suction source driven by the motor. The motor selectively rotates the fan to create a suction at the nozzle 42 such that debris and dust are sucked into the nozzle 42 along with air. Alternatively, the suction source or other components may be located in another part of the handle assembly 38. The physical layout and particular design of the floor cleaner 10 does not limit the scope of the invention. For example, many cosmetic changes may be made to the illustrated upright floor cleaner 10. Further, the floor cleaner 10 may include other features not mentioned herein. Further details about floor cleaners, and vacuums in particular, may be found in U.S. Patent Publication No. 2008/0271285 published Nov. 6, 2008, assigned to the same Assignee as the present invention, the contents of which are incorporated by reference herein.

With reference to FIG. 2, a door 94 is removably coupled to the handle assembly 38 to cover the dust cavity 58, and is movable between an installed or a closed position (FIG. 1) and a removed or an open position (FIG. 2). In the illustrated construction, the door 94 covers, and substantially encloses the dust cavity 58 when in the closed position, and is removed from the handle assembly 38 when in the open position. In other constructions, the door 94 may cover or enclose a portion of the dust cavity 58 when in the closed position. For example, the handle assembly 38 may enclose a portion of the dust cavity 58 or a portion of the dust cavity 58 may be uncovered. The door 94 includes a door handle 98, a closure assembly 102, and closure members 106.

The illustrated door handle 98 is formed as a single piece with the door 94. The door handle 98 has a U-shaped cross section and provides a space for the user to grasp the door handle 98. Alternatively, the door handle 98 may be formed separate from the door 94 and be fastened or fixed thereto. The illustrated door handle 98 is positioned on a top portion of the door 94 although, in other constructions, the position of the door handle 98 may be different.

The illustrated closure assembly 102 is positioned on the door handle 98 and includes a push button 110 (see FIG. 1) and a latch 114. The latch 114 is movable between a first position (shown) and a second position (not shown) in response to movement of the push button 110. When the door 94 is in the closed position, the latch 114 is biased toward the first position by a spring (not shown) and engages a corresponding latch structure 118 on the handle assembly 38 to maintain the door 94 in the closed position. The latch 114 rotates with respect to the door handle 98 from the first position to the second position when the push button 110 is pushed such that the latch 114 releases the latch structure 118 and the door 94 may be moved from the closed position to the open position. The illustrated latch 114 is shaped such that the latch 114 will rotate from the first position to the second position upon being pressured against the latch structure 118 when moving the door 94 from the open position to the closed position. In this way, the door 94 snaps into position from the open position to the closed position. In other constructions, the closure assembly 102 may be arranged differently to maintain the door 94 in the closed position, as desired.

The closure members 106 cooperate with the closure assembly 102 to maintain the door 94 in the closed position. The illustrated closure members 106 extend from the bottom of the door 94 and engage corresponding closure structure 122 in the handle assembly 38 to fix the bottom of the door 94 to the handle assembly 38. The illustrated closure structure 122 includes recesses sized to receive the closure members 106. In other constructions, the closure members 106 may be recesses and the closure structure 122 may be projections that extend from the handle assembly 38. Likewise, another form of engagement may be conceived to selectively fix the bottom of the door 94 to the handle assembly 38.

In operation, with the door 94 installed on the handle assembly 38 in the closed position, a user grasps the door 94 by the door handle 98 and depresses the push button 110. The latch 114 is moved from the first position to the second position and releases the latch structure 118 of the handle assembly 38. The user then rotates the door 94 away from the handle assembly 38 about the closure members 106. When the door 94 is substantially disengaged from the handle assembly 38, the door 94 is lifted such that the closure members 106 disengage the closure structure 122 of the handle assembly 38 and the door 94 is disconnected from the handle assembly 38 and in the open position.

To move the door 94 from the open position to the closed position, the user engages the closure members 106 with the closure structure 122 by inserting the projecting closure members 106 into the recesses of the closure structure 122. The door 94 is then rotated toward the handle assembly 38 until the latch 114 contacts the latch structure 118 of the handle assembly 38. The door 94 is then pushed toward the handle assembly 38 such that the latch 114 is moved, via its shape, from the first position to the second position. The latch 114 then snaps over and engages the latch structure 118 to secure the door 94 in the closed position. Alternatively, the user may depress the push button 110 to move the latch 114 to the second position before moving the door 94 from the open position to the closed position, then release the push button 110 to allow the spring to move latch 114 to the first position.

When the door 94 is in the closed position, the door handle 98 is used to lift and move the floor cleaner 10. When the door 94 is in the open position, the door handle 98 is used to lift and move the door 94. In other constructions, the door handle 98 may be a different shape or positioned differently, as desired.

With further reference to FIG. 2, the door 94 further includes an interior structure or an interior wall 126, a filter bag receiving portion 130 connected to the interior wall 126, and a filter bag retainer 134. The interior wall 126 of the door 94 is shaped to engage corresponding structure in the dust cavity 58. A seal 138 substantially surrounds the door 94 and engages the handle assembly 38 to substantially seal the dust cavity 58 when the door 94 is in the closed position. The interior wall 126 also separates the dust cavity 58 such that the filter bag 14 communicates with the suction vent 62 and cross flow between the suction vent 62 and the filter 66 is inhibited. As such, the second air flow path is maintained. Baffles 142 and other air flow structure are also provided, as desired. The interior wall 126 also includes filter bag receiving portion mounting structure in the form of four posts 146.

Figure 5:
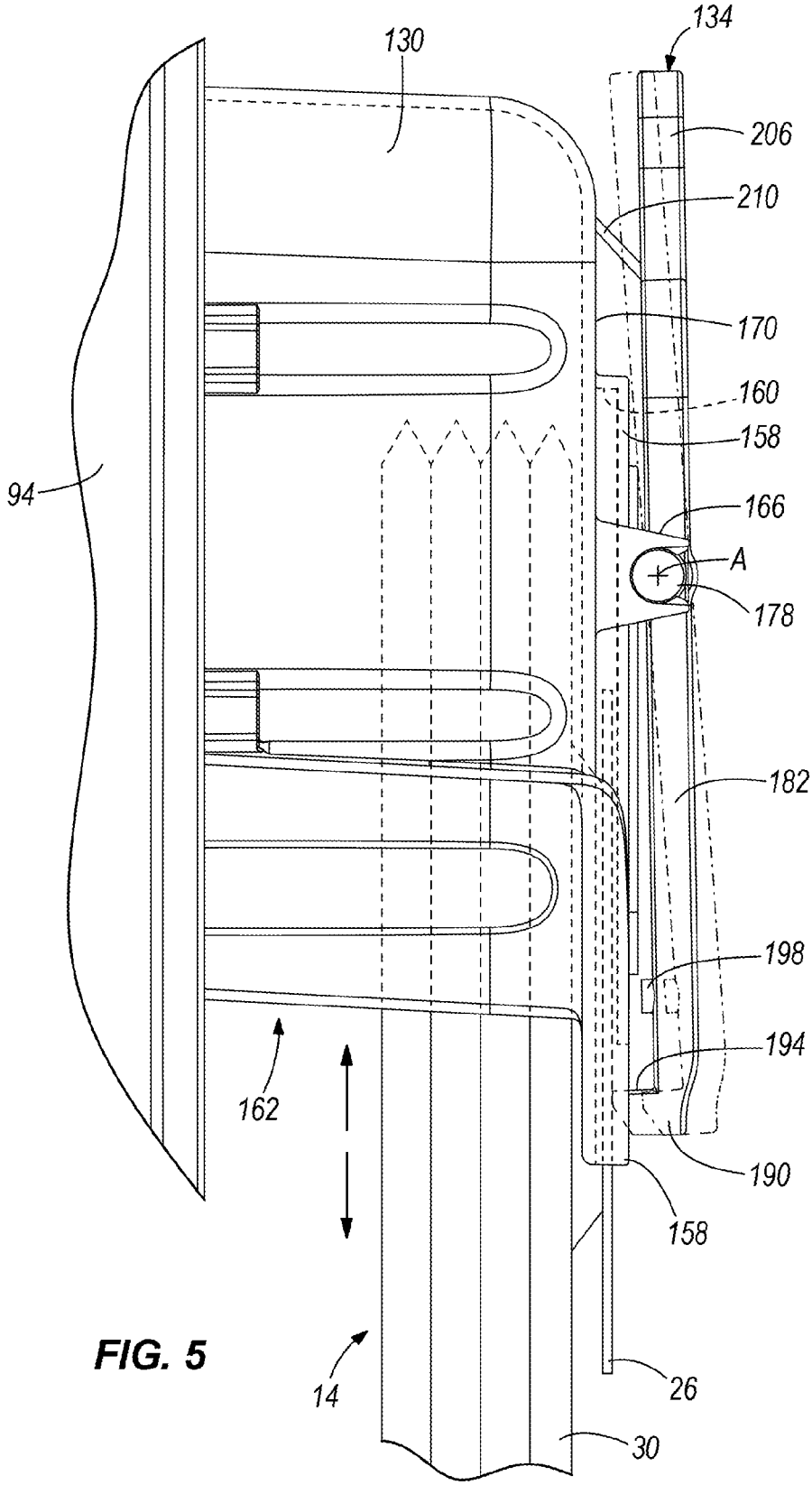
FIG. 5 is a side view of the vacuum door assembly of FIG. 4 showing the retained position and release position in dashed lines.
Figure 6:
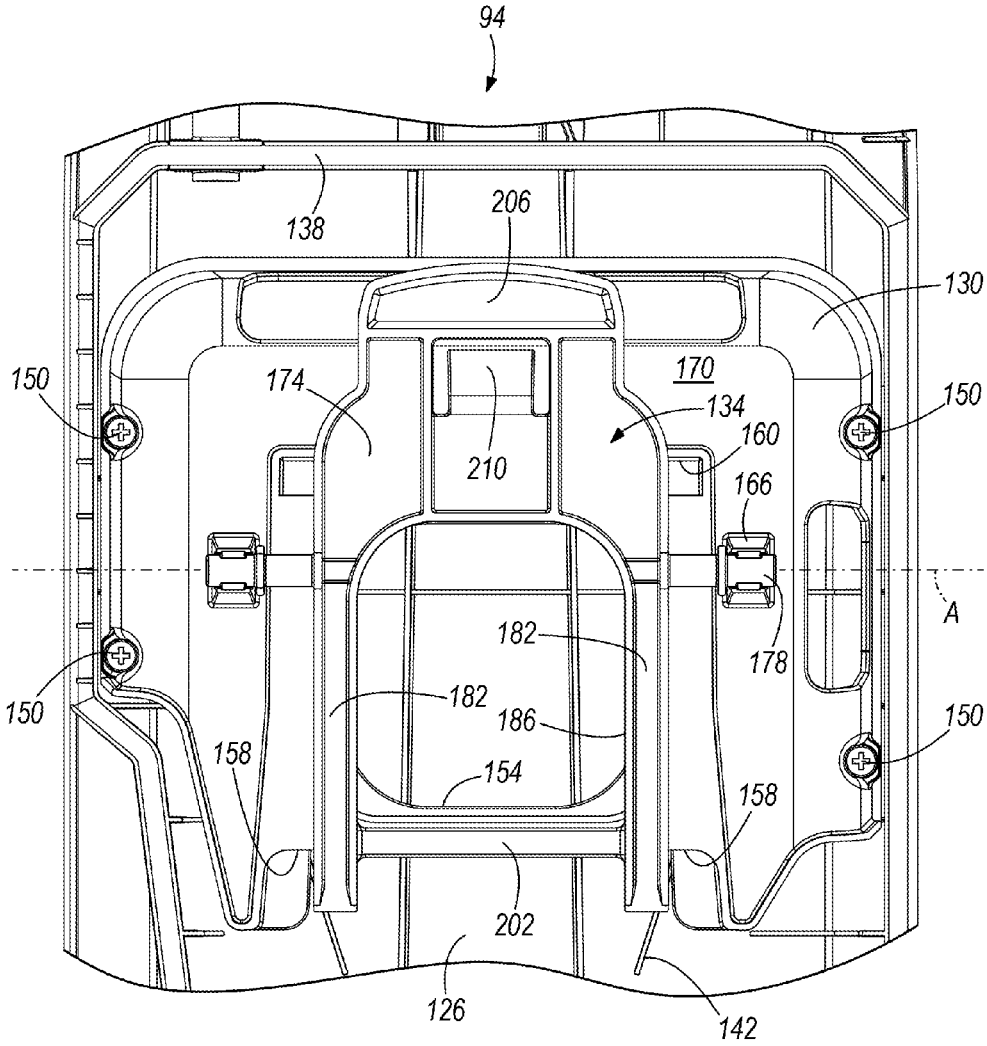
FIG. 6 is a front view of the vacuum door assembly of FIG. 4.

With reference to FIGS. 3-6, the filter bag receiving portion 130 is fastened to the interior wall 126 with four fasteners 150 such that filter bag receiving structure 130 is rigidly mounted thereto. In other constructions, the filter bag receiving portion 130 may be formed as a single piece with the door 94, or arranged in a different way. For example, the filter bag receiving portion 130 may be formed of several separately-formed pieces. The filter bag receiving portion 130 includes a receiving portion aperture 154 and a collar receiving slot 158 around the receiving portion aperture 154. The receiving portion aperture 154 is sized to correspond and cooperate with the bag aperture 26 and the collar receiving slot 158 is sized to slidingly receive the collar 22. The collar 22 is shown in FIG. 5 as being received or removed from slot 158, as indicated by the arrows. The collar receiving slot 158 is open at its lower end and closed at its upper end. The collar 22 slides into the collar receiving slot 158 from the bottom and comes to a stop when the collar 22 contacts a top end 160 of the collar receiving slot 158. The collar receiving slot 158 is sized such that the only substantial movement of the collar 22 with respect to the filter bag receiving portion 130 is sliding within the collar receiving slot 158. In other words, the collar 22 is inhibited from leaving the collar receiving slot 158 in any way but sliding out the bottom or open end of the slot.

The filter bag receiving portion 130 projects away from the interior wall 126 into the dust cavity 58 when the door 94 is in the closed position such that an open space 162 (FIG. 8) is provided between the filter bag receiving portion 130 and the interior wall 126. The filter bag 14 occupies the open space 162 when installed in the floor cleaner 10. Retainer engaging structure 166 is formed on an outer surface 170 of the filter bag receiving portion 130. The retainer engaging structure 166 pivotably engages the filter bag retainer 134. In the illustrated construction, the retainer engaging structure 166 includes two clips, but other connectors could used.

Figure 7:
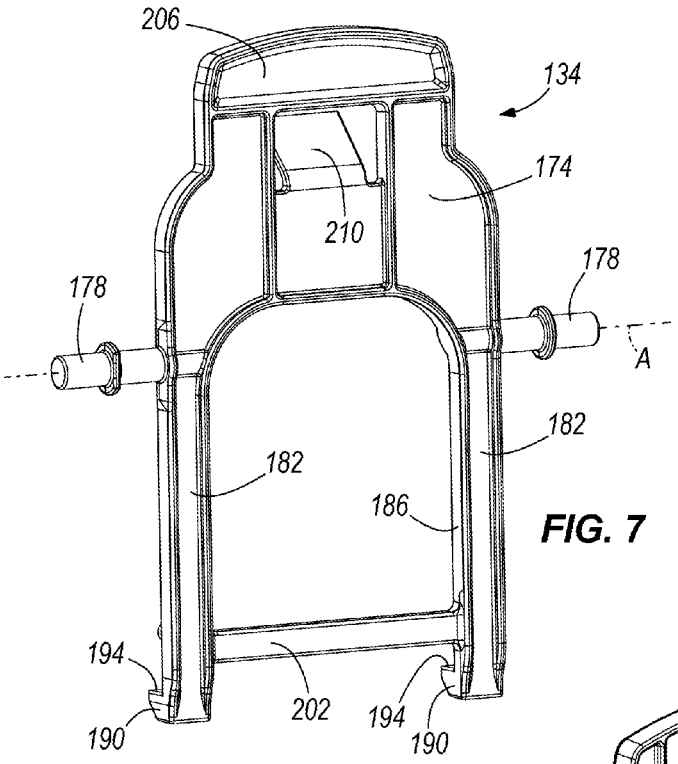
FIG. 7 is a perspective view of a filter bag retainer from the vacuum door assembly of FIG. 4.
Figure 8:
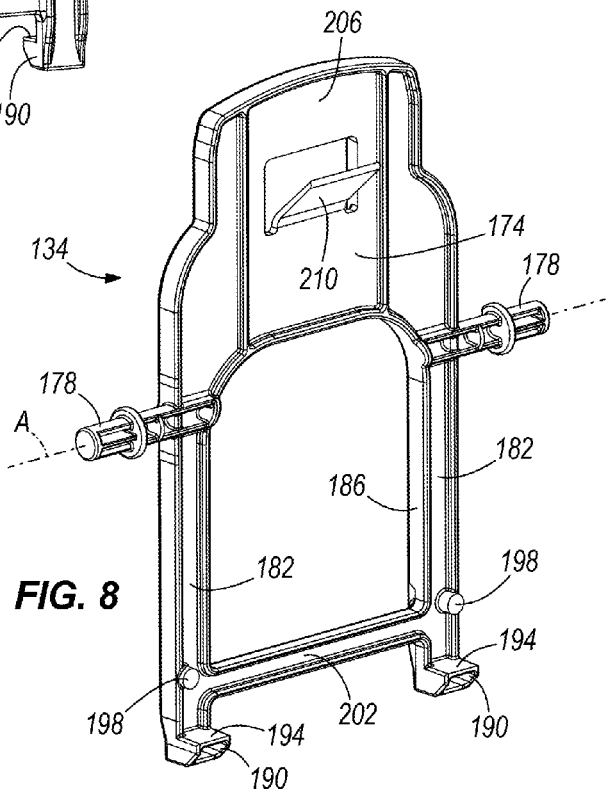
FIG. 8 is another perspective view of a filter bag retainer from the vacuum door assembly of FIG. 4.

With reference to FIGS. 7 and 8, the filter bag retainer 134 includes a body portion 174 and a pivot structure 178 that extends from the body portion 174 and engages the retainer engaging structure 166 (see FIG. 4) to pivotally mount the filter bag retainer 134 to the filter bag receiving portion 130. The illustrated pivot structure 178 includes two pins projecting from opposite sides of the filter bag retainer 134 which are aligned on an axis A. The filter bag retainer 134 pivots about the axis A relative to the door 94 between an engaged position (see FIG. 3) and a disengaged position (shown in broken lines in FIG. 5). In other constructions, the pivot structure 178 and the retainer engaging structure 166 may be different, as desired. For example, the retainer engaging structure 166 may include projections and the pivot structure 178 may include recesses that receive the projections. Other pivotable arrangements are conceived and may be applied, as desired.

The filter bag retainer 134 also includes retainer legs 182 that extend from the body portion 174 and away from to the pivot structure 178. The retainer legs 182 are spaced apart and shaped such that a retainer aperture 186 is defined therebetween. The retainer aperture 186 corresponds and cooperates with the receiving portion aperture 154 and the bag aperture 26. Each retainer leg 182 includes a projection 190 at a bottom or remote end thereof that extends toward the filter bag receiving portion 130 and provides a ledge 194. The ledge 194 is positioned below the lower or remote end of the collar receiving slot 158 such that when the collar 22 of the filter bag 14 is received within the collar receiving slot 158 and the filter bag retainer 134 is in the engaged position, the ledge 194 maintains the collar 22 within the collar receiving slot 158. In other constructions, the ledge 194 need not be positioned below the collar receiving slot 158. The ledge 194 functions to hold the collar 22 in place when the filter bag retainer 134 is in the engaged position and may be shaped differently, as desired.

Each retainer leg 182 also includes a standoff 198 (see FIG. 8) that contacts the outer surface 170 of the filter bag receiving portion 130 to position the filter bag retainer 134 when in the engaged position. When the filter bag retainer 134 is in not in the engaged position (i.e., moving toward the disengaged position or in the disengaged position), the standoffs 198 are not in contact with the outer surface 170 (see FIG. 5). In the illustrated construction, a support member 202 extends between the two retainer legs 182 to add rigidity. However, in other constructions the support member 202 may be removed or altered. In other constructions, the retainer legs 182 could be shaped differently or the body portion 174 may completely surround the retainer aperture 186 and provide the ledge 194 without any legs 182, as desired.

The filter bag retainer 134 includes a handle 206 positioned above the retainer aperture 186 when the floor cleaner is in an upright position. The handle 206 includes a spring in the form of a living spring 210 extending from the handle 206 toward the outer surface 170 of the filter bag receiving portion 130. The living spring 210 contacts the outer surface 170 and biases the filter bag retainer 134 toward the engaged position. To move the filter bag retainer 134 from the engaged position to the disengaged position, the user presses the handle 206 toward the filter bag receiving portion 130 against the bias of the living spring 210. The living spring 210 is compressed or loaded and the filter bag retainer 134 rotates to the disengaged position (see FIG. 5). To return the filter bag retainer 134 to the engaged position the user releases the handle 206 and the bias of the living spring 210 returns the filter bag retainer 134 to the engaged position.

In operation, the user removes the door 94 from the handle assembly 38 as described above. When the door 94 is in the open position, the user presses the handle 206 of the filter bag retainer 134 to move the filter bag retainer 134 to the disengaged position. The filter bag 14 is then installed into the filter bag receiving portion 130 by sliding the collar 22 into the collar receiving slot 158. The user then releases the handle 206 and the living spring 210 returns the filter bag retainer 134 to the engaged position. The ledge 194 engages the collar 22 and maintains the filter bag 14 in position within the door 94.

The user then moves the door 94 from the open position to the closed position as described above. When the filter bag 14 is installed and the door 94 is in the closed position, the dust tube 74 passes through the retainer aperture 186, the bag aperture 26, the receiving portion aperture 154, and into an interior space of the filter bag 14. The floor cleaner 10 is then used to clean floors. During a vacuuming operation, the fan is driven by the motor to create a suction at the nozzle 42. Air including debris flows from the nozzle 42, through the first air flow path, into the interior space of the filter bag 14, through the filter portion 30 thereby trapping the debris within the interior space, and through the second air flow path until the cleaned air exits the floor cleaner 10 at the exhaust vent 70.

When the filter bag 14 is sufficiently full and the user desires to dispose of the full filter bag 14, the user grasps the door handle 98 and actuates the closure assembly 102 such that the door 94 is moved from the closed position to the open position as described above. The user then carries the door assembly including the door 94, the filter bag receiving portion 130, the filter bag 14, and the filter bag retainer 134 to a garbage or waste receptacle.

To remove the full filter bag 14, the user holds the door 94 such that the full filter bag 14 is positioned vertically above the waste receptacle. The user then depresses the handle 206 to move the filter bag retainer 134 to the disengaged position. The full filter bag 14 then slides out of the collar receiving slot 158 and falls into the waste receptacle. Once the full bag is disposed of, a new filter bag 14 may be installed and the door 94 moved back to the closed position, as described above.

Thus, the invention provides a floor cleaner that allows a user to dispose of a full filter bag without contacting the full filter bag during disposal thereof The invention also provides a floor cleaner that allows a user to dispose of a full filter bag without reaching around the full filter bag such that the disposal action is very convenient and clean.

Various features and advantages of the invention are set forth in the following claims.

What is claimed is:

1. A floor cleaner comprising:
a nozzle;
a handle assembly pivotably mounted to the nozzle, the handle assembly including
a handle,
a motor housing supporting a suction source in fluid communication with the nozzle, and
a bag housing defining a filter cavity; and
a door removably coupled to the handle assembly, the door including a retainer configured to secure a filter bag including a bag aperture to the door and configured such that the door and the retainer are removable from the handle assembly as an assembly,
wherein the retainer includes a retainer handle positioned above the bag aperture, and
wherein the retainer includes a spring formed on the retainer handle.

2. The floor cleaner of claim 1, wherein the door substantially encloses the filter cavity when coupled to the handle assembly.

3. The floor cleaner of claim 1, wherein the retainer includes a body portion defining two legs and a retainer aperture located between the two legs.

4. The floor cleaner of claim 3, wherein the retainer aperture is substantially rectangular in shape.

5. The floor cleaner of claim 3, wherein each leg includes a projection configured to engage the filter bag.

6. The floor cleaner of claim 1, wherein the spring is a living spring.

7. The floor cleaner of claim 1, wherein the retainer rotates relative to the door between an engaged position and a disengaged position and the spring is configured to bias the retainer toward the engaged position.

8. A floor cleaner comprising:
a nozzle;
a handle assembly pivotably mounted to the nozzle, the handle assembly including
a handle,
a motor housing supporting a suction source in fluid communication with the nozzle, and
a bag housing defining a filter cavity; and
a door removably coupled to the handle assembly, the door including a retainer configured to secure a filter bag including a bag aperture to the door and configured such that the door and the retainer are removable from the handle assembly as an assembly,
wherein the retainer includes a retainer handle positioned above the bag aperture,
wherein when the door and the retainer are removed from the handle assembly the retainer is configured to move from an engaged position to a disengaged position such that the filter bag is secured when the retainer is in the engaged position and not secured when the retainer is in the disengaged position, and
wherein the retainer handle is configured to be manipulated by a user such that the retainer moves from the engaged position to the disengaged position without contact between the user and the filter bag.

9. A floor cleaner comprising:
a nozzle;
a handle assembly pivotably mounted to the nozzle, the handle assembly including,
a handle,
a motor housing supporting a suction source in fluid communication with the nozzle, and
a bag housing defining a filter cavity; and
a door removably coupled to the handle assembly and including a filter bag receiving portion and a filter bag retainer selectively coupled with the filter bag receiving portion, the filter bag receiving portion defining an aperture, the filter bag retainer configured to selectively couple a filter bag including a collar and a bag aperture to the filter bag receiving portion, the filter bag retainer including a retainer handle and a living spring formed on the retainer handle, the filter bag retainer movable between an engaged position and a disengaged position, the living spring configured to bias the filter bag retainer toward the engaged position, and
wherein the door and the filter bag retainer are removable from the handle assembly as an assembly.

10. The floor cleaner of claim 9, wherein filter bag retainer defines a retainer aperture corresponding with the bag aperture, and
wherein the retainer handle and the living spring are positioned above the retainer aperture.

11. The floor cleaner of claim 9, wherein the living spring contacts the filter bag receiving portion to bias the filter bag retainer toward the engaged position.

12. The floor cleaner of claim 9, wherein the filter bag retainer further includes coupling structure that pivotally connects the filter bag retainer to the filter bag receiving portion, the coupling structure defining an axis, the filter bag retainer configured to rotate about the axis between the engaged position and the disengaged position.

13. The floor cleaner of claim 9, wherein the filter bag receiving portion includes a slot configured to slidingly receive the collar, the filter bag retainer configured to maintain the filter bag in the slot when in the engaged position.

14. The floor cleaner of claim 9, wherein the filter bag retainer includes two legs and defines a retainer aperture located between the two legs; and
wherein the legs include projections configured to engage the collar.

15. A floor cleaner comprising:
a nozzle;
a handle assembly pivotably mounted to the nozzle, the handle assembly including
a handle,
a motor housing supporting a suction source in fluid communication with the nozzle, and
a bag housing defining a filter cavity; and
a door removably coupled to the handle assembly and including a filter bag receiving portion and a filter bag retainer selectively coupled with the filter bag receiving portion, the filter bag receiving portion defining an aperture,
wherein the filter bag retainer is configured to selectively couple a filter bag including a collar and a bag aperture to the filter bag receiving portion, the filter bag retainer including a retainer handle and a retainer leg configured to engage the collar, the filter bag retainer movable between an engaged position and a disengaged position, and wherein the door and the filter bag retainer are removable from the handle assembly as an assembly.

16. The floor cleaner of claim 15, wherein the filter bag receiving portion includes a slot configured to slidingly receive the collar, the retainer leg configured to maintain the filter bag in the slot when the filter bag retainer is in the engaged position.

17. The floor cleaner of claim 15, wherein the filter bag retainer further includes a living spring formed on the retainer handle.

18. The floor cleaner of claim 17, wherein filter bag retainer defines a retainer aperture corresponding with the bag aperture, and wherein the retainer handle and the living spring are positioned above the retainer aperture.

19. The floor cleaner of claim 15, wherein the filter bag retainer further includes coupling structure that pivotally connects the filter bag retainer to the filter bag receiving portion, the coupling structure defining an axis, the filter bag retainer configured to rotate about the axis between the engaged position and the disengaged position.

20. The floor cleaner of claim 1, wherein the retainer pivots with respect to the door.

* * * * *